US008528642B2

(12) United States Patent
Boone

(10) Patent No.: US 8,528,642 B2
(45) Date of Patent: Sep. 10, 2013

(54) WELL COMPLETION FOR VISCOUS OIL RECOVERY

(75) Inventor: Thomas J Boone, Calgary (CA)

(73) Assignee: ExxonMobil Upstream Research Company, Houston, TX (US)

( * ) Notice: Subject to any disclaimer, the term of this patent is extended or adjusted under 35 U.S.C. 154(b) by 235 days.

(21) Appl. No.: 13/102,322

(22) Filed: May 6, 2011

(65) Prior Publication Data

US 2011/0290503 A1 Dec. 1, 2011

(30) Foreign Application Priority Data

May 25, 2010 (CA) ..... 2704896

(51) Int. Cl.
*E21B 43/08* (2006.01)

(52) U.S. Cl.
USPC ..... 166/278; 166/51

(58) Field of Classification Search
USPC ..... 166/278, 51, 227, 236
See application file for complete search history.

(56) References Cited

U.S. PATENT DOCUMENTS

| | | | | |
|---|---|---|---|---|
| 3,705,625 | A | 12/1972 | Whitten et al. | 166/252 |
| 4,280,559 | A | 7/1981 | Best | 166/303 |
| 4,284,138 | A | 8/1981 | Allred | 166/233 |
| 4,344,485 | A | 8/1982 | Butler | 166/271 |
| 4,381,820 | A | 5/1983 | Wagner | 166/231 |
| 4,415,396 | A | 11/1983 | Wagner | 156/425 |
| 5,141,054 | A | 8/1992 | Alameddine et al. | 166/252 |
| 5,899,274 | A | 5/1999 | Frauenfeld et al. | 166/401 |
| 6,591,908 | B2 | 7/2003 | Nasr | 166/272.3 |
| 6,662,872 | B2 | 12/2003 | Gutek et al. | 166/272.4 |
| 6,708,759 | B2 | 3/2004 | Leaute et al. | 166/272.4 |
| 6,766,862 | B2 | 7/2004 | Chatterji et al. | |
| 7,073,577 | B2 | 7/2006 | Yu | 166/245 |
| 7,464,752 | B2 | 12/2008 | Dale et al. | 166/227 |
| 7,475,725 | B2 | 1/2009 | Yeh et al. | 166/278 |
| 7,708,494 | B2 * | 5/2010 | McLaughlin | 405/81 |
| 7,793,716 | B2 * | 9/2010 | Macias et al. | 166/236 |

(Continued)

FOREIGN PATENT DOCUMENTS

| | | |
|---|---|---|
| CA | 1246993 | 12/1988 |
| CA | 2250593 | 4/1999 |

(Continued)

OTHER PUBLICATIONS

Yeh, C. et al. (2009) "A Self-Mitigating Sand Control Screen," *SPE* 121844, 6 pgs.

*Primary Examiner* — William P Neuder
(74) *Attorney, Agent, or Firm* — ExxonMobil Upstream Research Company-Law Department

(57) ABSTRACT

Described is a well completion for evenly distributing a viscosity reducing injectant (e.g. steam and/or solvent, e.g. in SAGD or CSS) into a hydrocarbon reservoir (e.g. of bitumen), for evenly distributing produced fluids (most specifically vapor influx) and for limiting entry of particulate matter into the well upon production. On injection, the injectant passes through a limited number of slots in a base pipe, is deflected into an annulus between the base pipe and a screen or the like, and passes through the screen into the reservoir. On production, hydrocarbons pass from the reservoir through the screen into a compartmentalized annulus. The screen limits entry of particulate matter (e.g. sand). The hydrocarbons then pass through the slots in the base pipe and into the well. Where a screen is damaged, the compartmentalization and the slots in the base pipe limit particulate matter entry into the well.

15 Claims, 3 Drawing Sheets

(56) References Cited

U.S. PATENT DOCUMENTS

| | | | | |
|---|---|---|---|---|
| 8,316,952 | B2 * | 11/2012 | Moen | 166/373 |
| 2008/0179065 | A1 | 7/2008 | Vincent et al. | |
| 2009/0120641 | A1 | 5/2009 | Yeh et al. | 166/278 |
| 2009/0155599 | A1 | 6/2009 | Zaid et al. | 428/418 |
| 2009/0294128 | A1 | 12/2009 | Dale et al. | 166/306 |
| 2010/0044110 | A1 | 2/2010 | Bangru et al. | 175/61 |
| 2010/0096120 | A1 | 4/2010 | Ayasse | 166/55.1 |

FOREIGN PATENT DOCUMENTS

| | | |
|---|---|---|
| CA | 2249128 | 4/2000 |
| CA | 2219513 | 6/2003 |
| CA | 2416680 | 7/2003 |
| CA | 2418195 | 7/2004 |
| CA | 2349234 | 12/2004 |
| CA | 2582541 | 9/2007 |
| CA | 2647865 | 6/2009 |
| GB | 2357099 | 6/2001 |
| WO | WO 2006/108044 | 10/2006 |
| WO | WO 2006/108122 | 10/2006 |
| WO | WO 2007/040737 | 4/2007 |
| WO | WO 2007/078375 | 7/2007 |
| WO | WO2008/070990 | 6/2008 |
| WO | WO 2009/040502 | 4/2009 |
| WO | WO 2009/051881 | 4/2009 |

* cited by examiner

WELL COMPLETION FOR VISCOUS OIL RECOVERY

CROSS-REFERENCE TO RELATED APPLICATIONS

This application claims priority from Canadian patent application number 2,704,896 filed on May 25, 2010 entitled "Well Completion for Viscous Oil Recovery," the entirety of which is incorporated by reference herein.

The present invention is in the field of well completions for use in the recovery of in situ hydrocarbons from a subterranean reservoir.

FIELD OF THE INVENTION

The present invention is in the field of well completions for use in the recovery of in situ hydrocarbons from a subterranean reservoir.

BACKGROUND OF THE INVENTION

Viscous oil, such as heavy oil or bitumen, residing in reservoirs that are sufficiently close to the surface may be mined.

Viscous oil residing in reservoirs that are too deep for commercial mining may be recovered by in situ processes. Commonly, viscous oil is produced from subterranean reservoirs using in situ recovery processes that reduce the viscosity of the oil enabling it to flow to the wells; otherwise, an economic production rate would not be possible. In commercial in situ viscous oil recovery processes, the temperature or pressure is modified or a solvent is added to reduce the viscosity or otherwise enhance the flow of the viscous oil within the reservoir. Such a solvent may be referred to herein simply as a "solvent".

In certain processes, such as in SAGD (Steam Assisted Gravity Drainage), a dedicated injection well and a dedicated production well are used. The SAGD process involves injecting steam into the formation through an injection well or wells at a rate which is able to maintain a near constant operating pressure in the steam chamber. Steam at the edges of the steam chamber condenses as it heats the adjacent non-depleted formation. The mobilized oil and steam condensate flow via gravity to a separate production well located at the base of the steam chamber. An example SAGD is described in U.S. Pat. No. 4,344,485 (Butler).

In other processes, such as in CSS (Cyclic Steam Stimulation), the same well is used both for injecting a fluid and for producing oil. In CSS, cycles of steam injection, soak, and oil production are employed. Once the production rate falls to a given level, the well is put through another cycle of injection, soak, and production. An example of CSS is described in U.S. Pat. No. 4,280,559 (Best).

Steam Flood (SF) involves injecting steam into the formation through an injection well. Steam moves through the formation, mobilizing oil as it flows toward the production well. Mobilized oil is swept to the production well by the steam drive. An example of steam flooding is described in U.S. Pat. No. 3,705,625 (Whitten).

Other thermal processes include Solvent-Assisted Steam Assisted Gravity Drainage (SA-SAGD), an example of which described in Canadian Patent No. 1,246,993 (Vogel); Vapour Extraction (VAPEX), an example of which is described in U.S. Pat. No. 5,899,274 (Frauenfeld); Liquid Addition to Steam for Enhanced Recovery (LASER), an example of which is described in U.S. Pat. No. 6,708,759 (Leaute et al.); and Combined Steam and Vapour Extraction Process (SAVEX), an example of which is described in U.S. Pat. No. 6,662,872 (Gutek).

A process that can be operated thermally or non-thermally is CSDRP (Cyclic Solvent-Dominated Recovery Process), an example of which is described in Canadian Patent No. 2,349,234 (Lim).

One concern in thermal stimulation processes involving steam is the distribution of steam from horizontal wells into the formation. This is accomplished in conventional techniques by providing holes or slots in the casing. In a horizontal well which is used only for steam injection at subfracture reservoir pressures, steam distribution can be achieved by one of two means—the number and size of holes in the liner can be limited, such that at the desired steam injection rates, choked or critical (sonic) flow is achieved through the holes and equitable steam distribution at each hole location is achieved; or the target steam injection rates can be constrained such that only a minimal pressure drop occurs along the liner. Thus, the pressure gradient available for steam flow between the liner and reservoir at all points on the horizontal well is the dominant factor controlling the steam injection or production rate distribution along the well. Both of these design criteria put significant constraints on the steam injection operation. Frequently, the methodology used to achieve uniform distribution rates is to design a liner to achieve minimal pressure drops by increasing the liner diameter and limiting maximum steam injection rates, which have the disadvantages of increased cost and operational restrictions, respectively.

In a horizontal well which is used to inject steam at fracture pressures, neither of these steam distribution techniques is adequate. In a reservoir such as the Clearwater formation at Cold Lake in Alberta, Canada, the reservoir fracture pressure is typically 10 to 11 MPa. This pressure is too high to allow the critical flow design option to be successfully used. If a conventional liner were used, it is most likely that the horizontal well would fracture at only one location along the wellbore, and, in the following steam cycle, it may not be possible to move the fracture to a different portion of the wellbore.

Advantageously, the holes or slots in the well casing are also used in the production phase during which the mobile hydrocarbons flow into the well. However, particulate matter, such as sand and other formation fines, can either plug the holes or slots directly if relatively few openings are available, or they can also flow into the well with the produced hydrocarbons. Particulate matter settling inside the well can choke off sections of the well completely, thereby adversely affecting subsequent hydrocarbon production and steam injection.

In an effort to minimize the production of particulate matter with hydrocarbon fluids, well casings are often provided with a slotted liner or an external wire-wrap screen extending over a portion of the length of the horizontal portion of the well. In wire-wrap applications, holes are drilled in the well casing below the wire-wrap screens to provide an open area of about 8%. To achieve this degree of open area, hundreds of ⅜" diameter holes are required. For example, for a typical 8⅝" diameter pipe, 246⅜" holes are required per foot length of pipe to give an open area of 8.4%. The ratio of screened to blank sections of pipe is determined by the average % open area one wants for the application. Typically, the ratio is set to allow 1.5 to 3% of the base pipe to be open area. This relatively large open area is provided to minimize pressure drop constraints on, and velocities of, the fluids being produced from the reservoir. An external wire-wrap screen is then placed around the casing to reduce the flow of particulate matter through the holes. Slotted liners typically have corresponding open areas provided with the slots cut into the liner. In these designs, essentially no flow restrictions occur as the fluids pass through the slots or wire-wrap screen assemblies. Corresponding high velocities may expose the liner to erosion by the entrained sand.

An example of a known technique for distributing steam is described in U.S. Pat. No. 5,141,054 (Alameddine et al.) which relates to a limited entry steam heating method for distributing steam from a closed-end tubing in a perforated well casing. The tubing string has perforations to achieve critical flow conditions such that the steam velocity through the holes in the close-end tubing reaches acoustic speed. However, the large annulus flow area, plus the still large number of holes in the well casing, compromise the distribution of steam into the formation. Accordingly, critical flow is not maintained in the wellbore annulus and through the casing into the reservoir, so that the desired steam distribution control is lost.

Canadian Patent No. 2,219,513 (Bacon et al.) ("Bacon") describes a system and method for distributing steam and producing hydrocarbons through a well, to enhance steam distribution during a thermal stimulation phase, and to reduce the influx of particulate matter during a production phase, and where steam injection may occur at pressures below, up to, or exceeding the reservoir fracture pressure.

Bacon describes, in one aspect, a system for distributing steam in a steam injection phase and for producing hydrocarbon fluids in a production phase from a horizontal well in a reservoir, comprising: a base pipe having a plurality of spaced-apart orifices in the wall thereof; a plurality of second pipe sections disposed around the base pipe, and means for spacing each second pipe section from the base pipe to form an annulus between the base pipe and each second pipe section; each second pipe section having distribution means for distributing steam in the steam injection phase and for minimizing influx of particulate matter in the production phase; each second pipe disposed around a portion of the base pipe such that at least a portion of the distribution means is disposed over an orifice; whereby steam flowing through the base pipe flows outwardly through the plurality of orifices and is distributed outwardly to the reservoir through the distribution means during the steam injection phase; and, in the production phase, hydrocarbon fluids flow inwardly through the distribution means to the orifices and into the base pipe.

The system of Bacon provides enhanced steam distribution and enhanced hydrocarbon production, even though the criteria for the two phases are in opposition. In previous systems, the size and number of holes is large to reduce the pressure drop across the holes during the production phase. However, well casings used specifically for injection ideally have a reduced number of holes to increase the pressure drop of the steam through the holes.

Bacon uses a common set of holes for both steam distribution and hydrocarbon production phases and therefore a well can be used for thermal stimulation and/or hydrocarbon production phases.

FIGS. 1 to 3 herein are based on Bacon's FIGS. 1 to 3. Referring to FIG. 1, the system of Bacon has a base pipe 12 with an orifice 14 in the pipe wall. A second pipe 16 is disposed over a section of the base pipe 12 having the orifice 14. The second pipe 16 has a collar 18 and sections of wire-wrap screen 22 connected to either side of the collar 18 by connector rings 24. The second pipe 16 is disposed over the base pipe 12 such that the collar 18 is positioned over the orifice 14. The wire-wrap screen sections 22 are secured at the opposite end of the base pipe 12 by boss rings 26.

As shown more clearly in FIG. 2, the collar 18 is spaced from the base pipe 12 by rods 28 or the like to provide an annulus.

As shown more clearly in FIG. 3, support ribs 32 are used to space the wire-wrap screen sections 22 from the base pipe 12 to form an annulus in communication with the annulus between the base pipe 12 and the collar 18.

Alternatively, the collar 18 can be connected on either side to a section of slotted liner or other sand control device (not shown), instead of a wire-wrap screen.

Further, the collar 18 may be omitted. If, in Bacon's proposed application, potential erosion of the screens is not a concern, the collar may be replaced with a section of wire-wrap screen or other similar element.

The number of orifices 14 in a length of base pipe 12 is reduced in the system of the Bacon, as compared with conventional techniques, to increase the pressure drop across the orifices 14. The collar 18 and the wire-wrap screen sections 22 allow the steam to exit uniformly across the wire-wrap screen section 22 into the reservoir. The collar 18 preferably has a wall thickness which can withstand the force of the steam impacting the collar 18. Where the velocity of the steam is lower, the steam will distribute along the wire-wrap screen without the need for the collar.

In a situation in which steam injection at the design injection rates for the specific application is occurring at pressures less than the reservoir fracture pressure, the higher the pressure drop ratio is between that through the orifice 14 and that along the base pipe 12, the smaller will be the steam maldistribution occurring along the base pipe 12. Variations in reservoir quality and oil saturation along and external to the base pipe 12 will result in differences in the transmissibility of the steam at each orifice 14 location. In areas of the high steam transmissibility, the steam rate through the orifice 14 will want to increase. However, as the steam rate increases, the pressure drop through the orifice 14 also increases. This will reduce the maximum injection rate achievable through orifice 14. In areas with low steam transmissibility, the steam rate through the orifice 14 will want to decrease. However, as the steam rate decreases, the pressure drop through the orifice 14 also decreases. This will increase the minimum injection rate achievable through the orifice 14. Application of this design feature helps compensate for variations in reservoir quality along the base pipe 12 and thus, assists in improving the steam distribution into the reservoir along the base pipe 12. To ensure that it is not possible to fracture the reservoir at an orifice 14 where steam transmissibility is low, the steam pressure within the base pipe 12 should be maintained at less than the reservoir fracture pressure.

In a situation in which steam injection at the design injection rates for the specific application is occurring at or above reservoir fracture pressure, it is also necessary to ensure that pressure drop across the orifice 14 is larger than the expected variation in the reservoir fracture pressure along the base pipe 12. This will ensure that the steam exiting each orifice 14 along the base pipe 12 is capable of fracturing the reservoir at that location. Steam maldistribution can be reduced by ensuring that the orifice 14 pressure drop at the design injection rates is significantly higher than the expected variability in the reservoir fracture pressure along the base pipe 12.

In use, sections of the base pipe 12 are joined together to provide a predetermined number of orifices 14 along the length of the horizontal well. For example, to inject 1,500 $m^3/d$ (cold water equivalent) of 11 MPa steam (70% quality) into a reservoir, twenty ½" diameter holes would be required to achieve a pressure drop of 500 kPa across the orifices 14. The desired pressure drop is dependent on the reservoir fracture pressure and the variations thereof along the length of the well. The pressure drop across the orifices 14 is affected by the number and size of holes available for flow and the spacing thereof, and the diameter of the base pipe 12.

In conventional systems, the open area was too large to create a pressure constraint on fluids injected or produced. In Bacon, the deflection of high pressure steam through a limited number of holes creates good distribution during injection and the entry points available across the wire-wrap screen sections 22 allow for low pressure drop during production. The ½" diameter holes of the system of Bacon can be spaced 25 m apart, as compared to the 246⅜" diameter holes per foot in a conventional system. For example, twenty ½" diameter holes in a 500 m length 5½" diameter pipe represents an open area of 0.0012%. A person of ordinary skill in the art will understand that the structural integrity of a base pipe having an open area of 0.0012% is significantly greater than a conventional pipe having an open area of 8.4%, as discussed earlier. The cost of the base pipe of Bacon is reduced significantly, because the number of holes which must be cut in the base pipe is reduced drastically, and the wall thickness of Bacon need not be as great to support the number of holes being cut.

Preferably, the number and size of orifices 14 in the base pipe 12 is such that there is provided an open area of less than 0.5%. More preferably, the open area in the base pipe 12 is less than 0.1%. Even more preferably, the open area in the base pipe 12 is less than 0.01%.

For example, by spacing the twenty ½" diameter holes equally along a 500 m long 5½" diameter base pipe 12, the level of steam maldistribution (defined as 0.5 times the ratio of the steam injection rate through the first and last holes) when injecting 1,500 $m^3$/d of high pressure steam (70% quality) into a reservoir with a reservoir fracture pressure of 10 MPa would be less than 10%. In this example, the pressure drop is less than 50 kPa across the orifices in the production phase when the production rate is 300 $m^3$/d of liquids and 21,000 $sm^3$/d of wet vapors and the near wellbore reservoir is 500 kPa. This example illustrates that excellent distributions of both injected steam and produced fluids can be achieved through correctly sized and distributed orifices.

Bacon's system can be set-up, for example, such that a 1 meter long collar is positioned over the orifice 14 and is connected to a 3 meter long wire-wrap screen on either side thereof. As a result of the reduced number of orifices, the steam exits the base pipe 12 at each orifice 14 and the wire-wrap screens 22 on either side of the collar 18 effectively distribute the steam into the reservoir.

In a CSS process, steam is injected into the base pipe 12 and exits through the orifices 14. Steam is deflected off the collar 18 to the wire-wrap screen sections 22 for distribution into the reservoir. Heat is transferred to the reservoir to mobilize the hydrocarbon fluids. In the production phase, steam injection is discontinued and mobilized hydrocarbon fluids are allowed to flow to the distribution means which act to screen particulate matter from the fluid. Hydrocarbon fluid then travels in the annulus between the second pipe 16 to the orifice 14 into the base pipe 12 and is pumped to surface. Preferably, the steam injection and hydrocarbon fluids production steps are repeated cyclically.

In a SAGD process, steam is injected into the base pipe 12 and exits through the orifices 14. Steam is deflected off the collar 18 to the wire-wrap screen sections 22 for distribution into the reservoir. The number of orifices is constrained, such that the pressure drop through the orifices 14 is larger than the pressure drop along the liner itself. This ensures the equal distribution of steam along the injector and that either longer injectors and/or smaller diameter liners can be utilized. Heat is transferred to the reservoir to mobilize the hydrocarbon fluids. The mobilized hydrocarbon fluids drain to a production well where it is pumped to the surface. The production well may also comprise a base pipe 12 having orifices 14 with wire-wrap screen sections 22 disposed around the base pipe 12, and an annulus between the base pipe 12 and the wire-wrap screen sections 22. Mobile hydrocarbon fluids then flow through the annulus to the orifice 14 and into the base pipe. The number of orifices is constrained such that the pressure drop through the orifices 14 is larger than the pressure drop through either the wire-wrap screen sections 22 or along the liner itself. Shifting of the key flow restriction away from the wire-wrap sections 22 prevents excessive fluid velocities from mobilizing sand and thus eroding the screens. Having the pressure drops through the orifices 14 much larger than the pressure drop along the liner, ensures that the pressure drop within the liner does not adversely affect the inflow performance of the production well and thus, more uniform hydrocarbon fluid influx occurs along the wellbore. This design feature will allow the utilization of longer producers and/or smaller diameter producers. A second benefit of this design feature is that at sections of the wellbore which are coning steam from the steam chamber, the presence of the limited number of orifices restricts the rate which steam can enter the production wellbore. This reduces steam production without adversely affecting the hydrocarbon fluid production from the remaining section of the wellbore.

In a SF process, steam is injected into the base pipe 12 and exits through the orifices 14. Steam is deflected off the collar 18 to the wire-wrap screen sections 22 for distribution into the reservoir. The number of orifices is constrained such that the pressure drop through the orifices 14 is larger than the pressure drop along the liner itself. This ensures the equal distribution of steam along the injector and that either longer injectors and/or smaller diameter liners can be utilized. Heat is transferred to the reservoir to mobilize the hydrocarbon fluids. The mobilized hydrocarbon fluids are displaced to a production well where it is pumped to the surface. The production well may also comprise a base pipe 12 having orifices 14 with wire-wrap screen sections 22 disposed around the base pipe 12 and an annulus between the base pipe 12 and the wire-wrap screen sections 22. Mobile hydrocarbon fluids then flow through the annulus to the orifice 14 and into the base pipe 12. The number of orifices is constrained such that the pressure drop through the orifices 14 is larger than the pressure drop through either the wire-wrap screen sections 22 or along the liner itself. Shifting of the key flow restriction away from the wire-wrap sections 22 prevents excessive fluid velocities from mobilizing sand and thus eroding the screens. Having the pressure drops through the orifices 14 much larger than the pressure drop along the liner ensures that the pressure drop within the liner does not adversely affect the inflow performance of the production well, and thus, either longer producers and/or smaller diameter producers can be utilized.

A key limitation of screened completions is that they tend not to be mechanically robust. Screens are relatively easily damaged during installation. They are also susceptible to erosion when steam or gas influx occurs rapidly in a concentrated area. This latter limitation also applies to slotted liners but to a lesser extent. Even a single localized failure in one screen along a well can render part or all of the well ineffective because sand influx into the well can effectively block flow. In Bacon's system, where a screen becomes damaged, even in only one location, sand will pass through the damaged portion of the screen, through the round orifice in the base pipe, and into the well. As a result, operational processes are typically constrained to limit the risk of a failure. For example, during start-up of SAGD well pairs, a relatively gentle process is typically employed so that steam breakthrough in a localized region will not fail a screen. A more robust completion design with injection and inflow control would allow much more rapid and aggressive start-up procedures for SAGD well pairs.

SUMMARY OF THE INVENTION

It is an object of the present invention to obviate or mitigate at least one disadvantage of previous systems or methods.

In one aspect, the present invention provides a well completion for evenly distributing a viscosity reducing injectant (e.g. steam and/or solvent, e.g. in SAGD or CSS) into a hydrocarbon reservoir (e.g. of bitumen) and for limiting entry of particulate matter into the well upon production. On injection, the injectant passes through a limited number of slots in a base pipe, is deflected into an annulus between the base pipe and a screen or the like, and passes through the screen into the reservoir. On production, hydrocarbons pass from the reservoir through the screen into a compartmentalized annulus. The screen limits entry of particulate matter (e.g. sand). The hydrocarbons then pass through the slots in the base pipe and into the well. Where a screen is damaged, the compartmentalization and the slots in the base pipe limit particulate matter entry into the well.

In another aspect, there is provided a system for distributing a viscosity reducing injectant, in an injection phase and for producing hydrocarbons in a production phase from a well in a reservoir, comprising: a base pipe having a plurality of spaced-apart slots in the wall thereof, wherein the plurality of slots represent an open area in the base pipe of less than 0.5%, and wherein the slots are sized to limit influx of particulate matter in the production phase; a plurality of second pipe sections disposed around the base pipe, and spacing means for spacing each second pipe section from the base pipe to form an annulus between the base pipe and each second pipe section; each second pipe section having distribution means for distributing the injectant in the injection phase and for limiting influx of particulate matter in the production phase; each second pipe disposed around the base pipe such that at least a portion of the distribution means is disposed over at least one of the slots; and whereby the injectant flowing through the base pipe flows outwardly through the plurality of slots and is distributed outwardly to the reservoir through the distribution means during the injection phase; and, in the production phase, hydrocarbons flow inwardly through the distribution means to the slots and into the base pipe.

The following features may be present. At least two first dividers may be disposed between the base pipe and each second pipe section compartmentalizing the annulus into first compartments for feeding the inwardly flowing hydrocarbons to at least one of the slots. The first dividers may provide continuous compartmentalization between joined base pipe sections which form the base pipe. Each first compartment may feed exactly one of the slots. The distribution means may comprise: at least one collar, each collar being disposed over at least one of the slots in the base pipe when the second pipe section is disposed around the base pipe; and a wire-wrap screen, slotted liner, or a steel wool screen. At least two second dividers may be disposed between the wire-wrap screen, slotted liner, or steel wool screen, and the base pipe compartmentalizing an annulus therebetween into second compartments feeding the inwardly flowing hydrocarbons to the first compartments. The slots may be larger than openings in the distribution means for distributing the injectant into the reservoir. Openings in the distribution means for distributing the injectant into the reservoir may be sized to stop the largest 30-50% of particulate matter on a mass % basis, in the production phase; and the slots may be sized to stop the largest 1 to 10% of particulate matter, on a mass % basis, in the production phase. The slots may be sized 0.25 mm to 0.75 mm by 10 mm to 100 mm. A surface surrounding each slot may comprise a wear resistant material. A surface surrounding each slot may comprise an anti-fouling material. The injectant may be steam, vaporized solvent, or a combination thereof. The slots may be sized for limiting entry of a vaporized fraction of the injectant, in the production phase. The hydrocarbons may be a viscous oil having a viscosity of at least 10 cP at initial reservoir conditions. The distribution means may comprise a wire-wrap screen, a slotted liner, or a steel wool screen. The plurality of slots may represent an open area in the base pipe of less than 0.1%, less than 0.01%, or 0.0001% to 0.001%. The well may be a horizontal well. The well may be used as a production well.

In another aspect, there is provided a method for distributing a viscosity reducing injectant, and producing hydrocarbons from a well in a reservoir, comprising the steps of: injecting the injectant, into a base pipe having a plurality of spaced-apart slots in the wall thereof, wherein the plurality of slots represent an open area in the base pipe of less than 0.5%, and wherein the slots are sized to limit influx of particulate matter in the well; a plurality of second pipe sections being disposed around the base pipe; each second pipe section being spaced from the base pipe to form an annulus therebetween; each second pipe section having a distribution means for distributing the injectant; each second pipe section being disposed around the base pipe such that at least a portion of the distribution means is disposed over the slots, such that the injectant flows outwardly from the slots to the distribution means of each second pipe section into the reservoir such that hydrocarbons in the reservoir become mobile; and producing the hydrocarbons by discontinuing injection and allowing the hydrocarbons to flow through the distribution means into the annulus between each second pipe section and the base pipe such that influx of particulate matter is limited by the distribution means. The injecting and producing steps may be repeated cyclically. The well may be a horizontal well.

In another aspect, there is provided a method for injecting a viscosity reducing injectant, and producing hydrocarbons from a reservoir, using two wells, comprising the steps of: injecting the injectant into the reservoir through an injection well such that hydrocarbons in the reservoir become mobile; and producing the hydrocarbons from the reservoir by withdrawing fluid from a production well, wherein the production well includes a base pipe having a plurality of slots in the wall thereof, wherein the plurality of slots represent an open area in the base pipe of less than 0.5%, and wherein the slots are sized to limit influx of particulate matter in the production well; a plurality of second pipe sections being disposed around the base pipe, each second pipe section being spaced from the base pipe to form an annulus therebetween; each second pipe section having distribution means, each second pipe section disposed around the base pipe such that the hydrocarbons flow through the distribution means into the annulus between each second pipe section and the base pipe for limiting influx of particulate matter. The injection well may be a horizontal well. The production well may be a horizontal well.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Definitions

Figure 1:
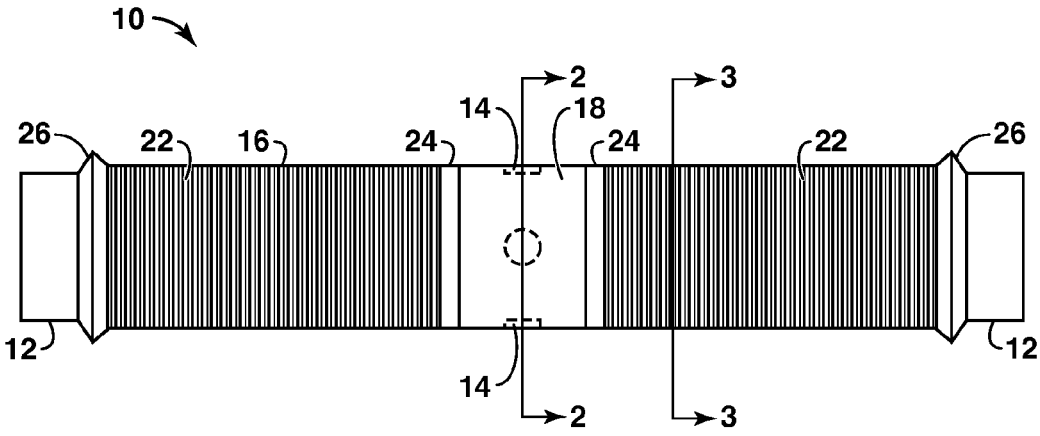
FIG. 1 Prior Art
FIG. 1 is a side elevation view of the system of Canadian Patent No. 2,219,513 (Bacon)

The term "viscous oil" as used herein means a hydrocarbon, or mixture of hydrocarbons, that occurs naturally and that has a viscosity of at least 10 cP (centipoise) at initial reservoir conditions. Viscous oil includes oils generally defined as "heavy oil" or "bitumen". Bitumen is classified as an extra heavy oil, with an API gravity of about 10° or less, referring to its gravity as measured in degrees on the American Petroleum Institute (API) Scale. Heavy oil has an API gravity in the range of about 22.3° to about 10°. The terms viscous oil, heavy oil, and bitumen are used interchangeably herein since they may be extracted using similar processes.

"In situ" is a Latin phrase for "in the place" and, in the context of hydrocarbon recovery, refers generally to a subsurface hydrocarbon-bearing reservoir. For example, in situ temperature means the temperature within the reservoir. In another usage, an in situ oil recovery technique is one that recovers oil from a reservoir within the earth.

The term "formation" as used herein refers to a subterranean body of rock that is distinct and continuous. The terms "reservoir" and "formation" may be used interchangeably.

The term "viscosity reducing injectant" means a fluid that is injected into the reservoir for reducing the viscosity of the in situ hydrocarbons. For example, the injectant may comprise steam, water, vaporized solvent, liquid solvent, or a combination thereof. Examples of recovery processes using such injectants are provided in the Background section.

By replacing the round orifices of Bacon, which do not hold back particulate matter, with slotted orifices (or "slots"), the advantages of choked flow can be retained and a secondary filter to particulate matter (e.g. sand) influx can be achieved. The width of each slot is preferably larger than the width of each screen opening and small enough that larger sand particles will bridge across the slot. As a result, if a section of the screen fails, only a limited volume of sand will enter the wellbore liner before larger particles bridge across the slot thereby reducing the risk of a catastrophic well failure. The orientation of the slots may differ from what is shown in the Figures. "Slot" means an orifice than is wider in one direction than another and which limits passage of particulate matter to some extent.

The exterior screen or the like provides primary sand control, and the slots provide secondary sand control. The slots are sized to hold back larger particles as compared to the screen. By way of example, the screen may be sized to hold back the largest 30-50% of particulate matter on a mass % basis. The slots may be sized to hold back the largest 1 to 10% of particulate matter, on a mass % basis. As a result, during normal operation, particulate matter that passes through an undamaged screen would not be expected to be held back by a slot. However, if a screen is damaged and the full distribution of particulate matter reaches a slot, the slot will become plugged with larger particulates.

In one embodiment, by compartmentalizing the well completion, the consequences of a damaged screen can be further mitigated. Compartmentalization is achieved by separating the annulus between the screen and the slots into compartments. Therefore, only a fraction of the hydrocarbons flowing into each screen section flows to one slot. For example, if the design includes four slots in a screen section, only one quarter of the flow volume between the screen section and base pipe would feed that slot. As a result, when only limited damage occurs to a section of a screen, only one slot would become effectively plugged with sand but the other three slots would not be impacted, and the liner section's performance would only be minimally impacted.

While reference is made to screens, alternative particulate matter control elements may be used, as described in the Background section. For instance, a slotted liner may be used.

In FIGS. 4 to 9, elements that are the same as in FIGS. 1 to 3 (based on Bacon) are identified by the same reference numbers and may operate in the same manner as described in Bacon insofar as this is not inconsistent with the description below.

Figure 2:
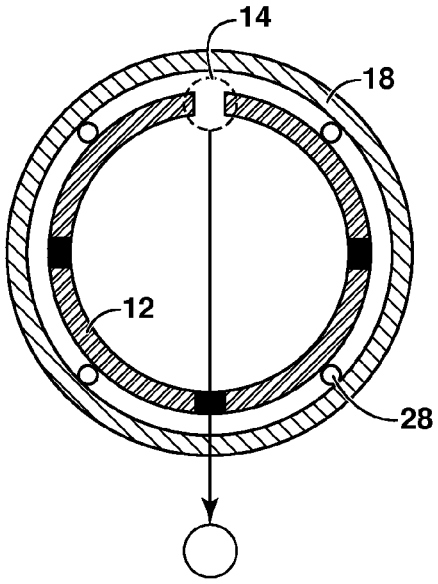
FIG. 2 Prior Art
FIG. 2 is a cross-sectional view along the line 2-2 in FIG. 1.
Figure 3:
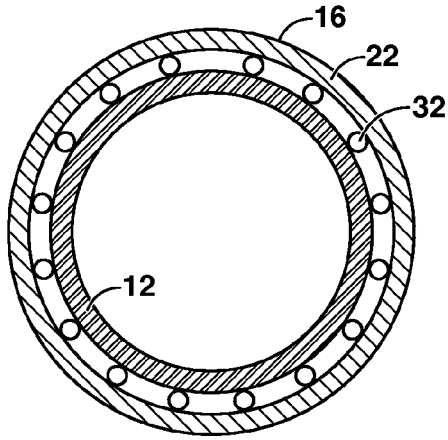
FIG. 3 Prior Art
FIG. 3 is a cross-sectional view along the line 3-3 in FIG. 1.
Figure 4:
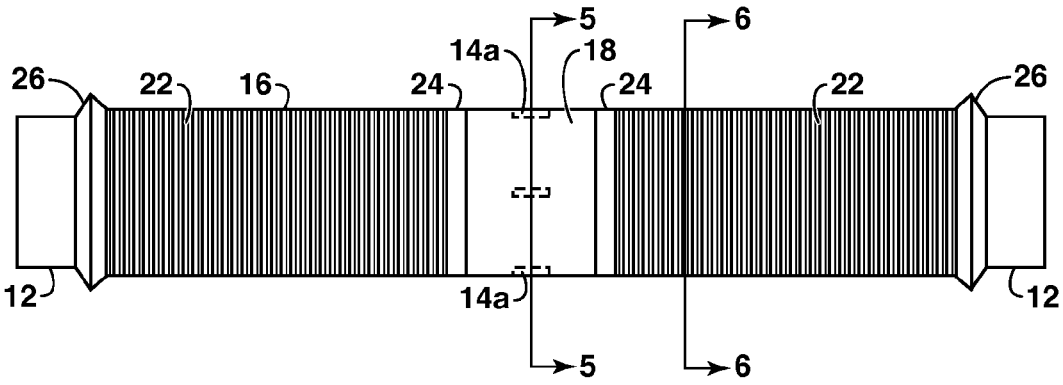
FIG. 4 is a side elevation view of a system of a disclosed embodiment.
Figure 5:
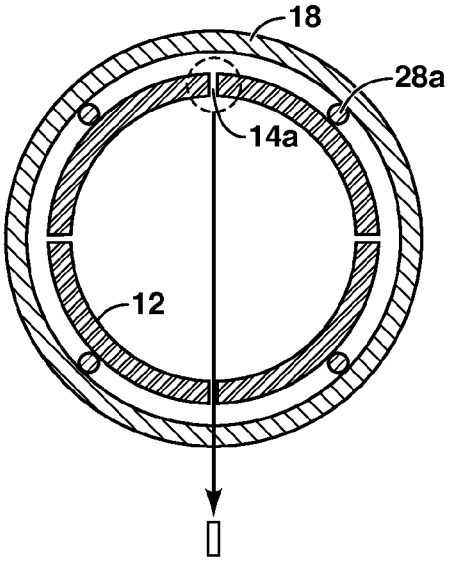
FIG. 5 is a cross-sectional view along the line 5-5 in FIG. 3.
Figure 6:
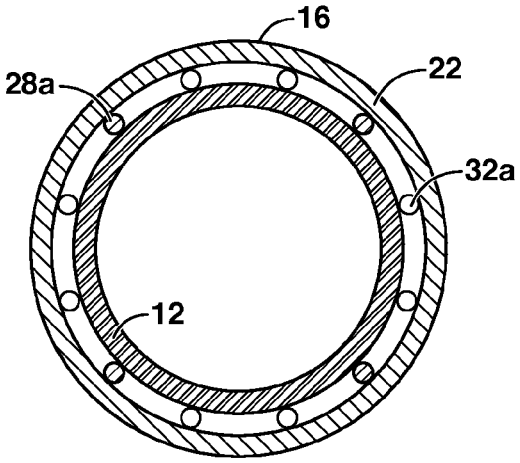
FIG. 6 is a cross-sectional view along the line 6-6 in FIG. 3.

Importantly, the round orifices 14 seen in FIGS. 1 and 2 (based on Bacon), which do not hold back particulate matter, become slots 14*a*, which act as a secondary filter, as seen in FIGS. 4, 5, 7, and 8. In FIG. 2 (based on Bacon), the collar 18 is spaced from the base pipe 12 by rods 28 to provide an annulus and support ribs 32 are used to space the wire-wrap screen sections 22 from the base pipe 12 to form an annulus in communication with the annulus between the base pipe 12 and the collar 18. By contrast, in embodiments of the instant invention, first dividers 28*a* (as seen in FIGS. 5, 6, 8 and 9) not only provide spacing between the collar 18 and the base pipe 12, but are configured to provide compartmentalization along the base pipe so that each first divider separates two adjacent first compartments of the annulus between the base pipe 12 and both the collar 18 and the screen 22. As seen in FIGS. 6 and 9, the first dividers 28*a* extend into the annulus between the screen 22 and the base pipe 12. The first dividers 28*a* are shown with a diagonal line therethrough in the Figures to distinguish them from second dividers 32*a*, discussed below. The first dividers span the length of the base pipe sections. The "first dividers" are physical elements providing division and restricting flow between the first compartments. When several base pipe sections are joined together for use, these first dividers provide continuous compartmentalization along the resultant length. Because these first dividers 28*a* extend into the area of the screen, they can also provide at least part of the spacing function to space the screen from the base pipe.

Also by contrast with Bacon, in embodiments of the instant invention, the second dividers 32*a* are not only used to space the wire-wrap screen sections 22 from the base pipe 12 to form an annulus in communication with the annulus between the base pipe 12 and the collar 18, but are configured to provide compartmentalization in this annulus so that a second divider separates two adjacent second compartments of the annulus. These "second dividers" are physical elements providing division and restricting flow between the second compartments. The second dividers need not extend into the collar section, and are therefore not seen in FIGS. 5 and 8.

In one embodiment, rather than having a two-tiered compartmentalization as shown in FIGS. 4 to 9, one set of compartments may be provided by the first dividers. Conveniently, each compartment may be in fluid communication with one slot.

Compartmentalization and spacing may be provided by the same or by different physical elements. Further, the shapes of the dividers are not particularly limited so long as they provide their stated function. As seen in the Figures, the compartments may be arcuate.

The distinction between Bacon's rods, and the first dividers discussed herein, is important. Bacon's rods do not provide compartmentalization since sand can pass around the rods such that the annulus between the screen and the base pipe is a continuous volume. The rods of Bacon were included to provide spacing. By contrast, the first dividers described herein are designed to provide an advantageous compartmentalization not realized by Bacon's design.

Figure 7:
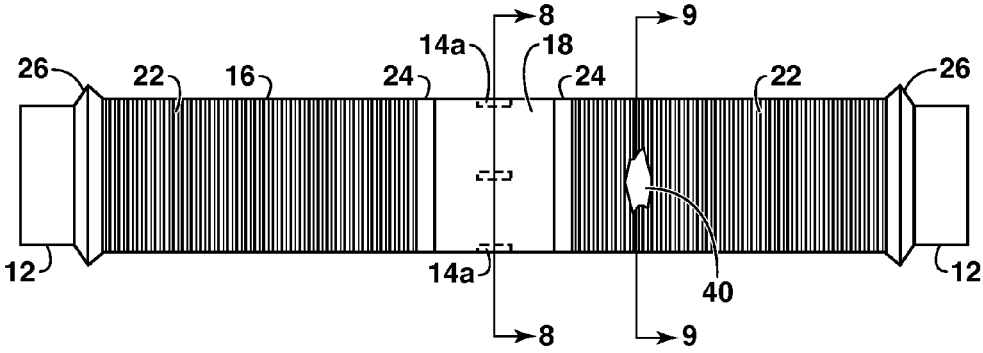
FIG. 7 is a side elevation view of a system of a disclosed embodiment, showing a damaged screen.
Figure 8:
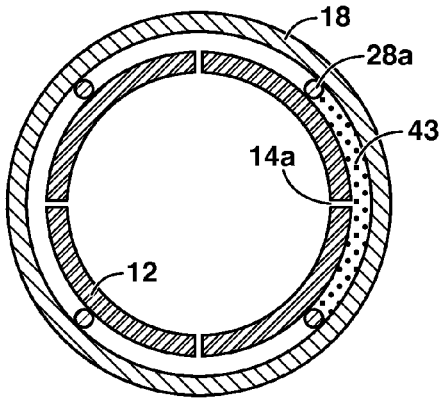
FIG. 8 is a cross-sectional view along the line 8-8 in FIG. 7.
Figure 9:
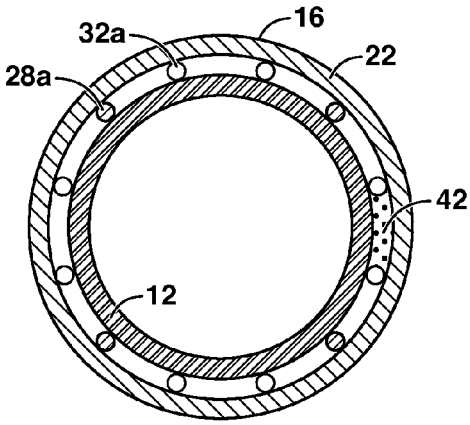
FIG. 9 is a cross-sectional view along the line 9-9 in FIG. 7.

FIGS. 7 to 9 illustrate a damaged screen. The damaged portion 40 of the screen 22 is shown in FIG. 7. FIG. 9 shows sand 42 that has passed through the damaged portion 40 of the screen 22 and into a second compartment in the annulus between the screen 22 and the base pipe 12. The second dividers 32*a* prevent this sand from moving to other second compartments. FIG. 8 shows sand 43 that has passed from the second compartment in the annulus between the screen 22 and the base pipe 12 into a first compartment in the annulus between the collar 18 and the base pipe 12. The slot 14*a* limits passage of the sand into the well. The first dividers prevent this sand from moving to annulus compartments. Thus, the slots and compartmentalization limit degradation of well productivity caused by sand influx through a damaged screen.

An example of the total length of the slots for a screened section is in the range of 50 to 500 mm. As a result, a single screened joint may have, for example, 4 to 20 slots. This is in the range of 0.0001% to 0.001% of the area of the base pipe.

To mitigate scale formation surrounding the slotted orifices (1) the slots may be coated with a material that limits adhesion of scale prior to installation (such as is described in U.S. Patent Publication No. 2009/0155599 (Zaid)), and/or (2) acid injection could be used to remove scale after installation. To mitigate erosion, the slots may be coated with a wear resistant material, such as a ceramic material Embodiments of the present invention are particularly suited to SAGD, CSS, and SF processes for the control of steam distribution during a steam injection phase, and the control of influx of particulate matter during the production phase. It will be understood that the well casing of embodiments of the present invention may also be used for injection of other miscible or immiscible agents useful in hydrocarbon recovery, for instance in vaporized solvent processes, or steam-solvent hybrid processes, such as those described above.

At the design injection rates, the pressure drop through the slots is larger than the pressure drop along the base pipe. During hydrocarbon fluid production, the pressure drop from the reservoir to the spaced-apart slots is low due to the presence of the screens.

The well(s) may be horizontal or inclined.

Preferably, the number and size of orifices 14*a* in the base pipe 12 is such that there is provided an open area of less than 0.5%. More preferably, the open area in the base pipe 12 is less than 0.1%. Even more preferably, the open area in the base pipe 12 is less than 0.01%.

While the slots are described as being "in" the base pipe, this is intended to include a design in which elements are joined to the base pipes, and the slots are provided in these elements, provided that the slots perform their function as described herein.

The design by Bacon was particularly suited to wells where it was desirable to control the distribution of steam during injection and minimize the impact of pressure drop during production. Embodiments of the instant invention are particularly suited to production wells where it is desirable to be able to aggressively produce the well and ensure a uniform production distribution. For example, in a SAGD application, it is desirable to maximize production of liquids from a well but minimize vapor production. The slots can be sized to limit the rate at which vapor can be produced from a section of the well. Since, typically, the well will be designed to produce only a small fraction of the injected vapor, the slot area will typically be less than that for a production well. Further, production wells are at higher risk than injection wells for sand influx and therefore replacing round orifices which do not provide filtration with slots that provide secondary protection against sand production is particularly advantageous. Use of embodiments of the instant invention in SAGD applications may also enable faster start-up of the SAGD process by enabling earlier injection into the injection well at higher pressures and rates while mitigating the risk of steam channeling at high rates between the injection and production well.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

The invention claimed is:

1. A system for distributing a viscosity reducing injectant, in an injection phase and for producing hydrocarbons in a production phase from a well in a reservoir, comprising:

a base pipe having a plurality of spaced-apart slots in a wall of the base pipe, wherein the plurality of spaced-apart slots represent an open area in the base pipe of less than 0.5%, and wherein the plurality of spaced-apart slots are sized to limit influx of particulate matter in the production phase;

a plurality of second pipe sections around the base pipe, and a spacing element for spacing each of the plurality of second pipe sections from the base pipe to form an annulus between the base pipe and each of the plurality of second pipe sections;

each of the plurality of second pipe sections having a distribution element for distributing the injectant in the injection phase and for limiting influx of particulate matter in the production phase;

each of the plurality of second pipe sections around the base pipe such that at least a portion of the distribution element is over at least one of the plurality of spaced-apart slots, wherein the injectant flowing through the base pipe flows outwardly through the plurality of spaced-apart slots and is distributed outwardly to the reservoir through the distribution element during the injection phase; and, in the production phase, hydrocarbons flow inwardly through the distribution element to the plurality of spaced-apart slots and into the base pipe; and at least two first dividers between the base pipe and each of the plurality of second pipe sections compartmentalizing the annulus into first compartments for feeding the inwardly flowing hydrocarbons to at least one of the plurality of spaced-apart slots.

2. The system of claim 1, wherein the at least two first dividers provide continuous compartmentalization between joined base pipe sections which form the base pipe.

3. The system of claim 1, wherein the distribution element comprises:

at least one collar, each of the at least one collar over at least one of the plurality of spaced-apart slots in the base pipe when each of the plurality of second pipe sections is disposed around the base pipe; and a wire-wrap screen, slotted liner, or a steel wool screen.

4. The system of claim 1, wherein the plurality of spaced-apart slots are larger than openings in the distribution element for distributing the injectant into the reservoir.

5. The system of claim 1, wherein openings in the distribution element for distributing the injectant into the reservoir are sized to stop the largest 30-50% of particulate matter on a mass % basis, in the production phase; and wherein the plurality of spaced-apart slots are sized to stop the largest 1 to 10% of particulate matter, on a mass % basis, in the production phase.

6. The system of claim 1, wherein the plurality of spaced-apart slots are sized 0.25 mm to 0.75 mm by 10 mm to 100 mm.

7. The system of claim 1, wherein a surface surrounding each of the plurality of spaced-apart slots comprises a wear resistant material.

8. The system of claim 1, wherein a surface surrounding each of the plurality of spaced-apart slots comprises an anti-fouling material.

9. The system of claim 1, wherein the plurality of spaced-apart slots represent an open area in the base pipe of less than 0.1%.

10. The system of claim 1, wherein the plurality of spaced-apart slots represent an open area in the base pipe of less than 0.01%.

11. A system for distributing a viscosity reducing injectant, in an injection phase and for producing hydrocarbons in a production phase from a well in a reservoir, comprising:

a base pipe having a plurality of spaced-apart slots in a wall of the base pipe, wherein the plurality of spaced-apart slots represent an open area in the base pipe of less than 0.5%, and wherein the plurality of spaced-apart slots are sized to limit influx of particulate matter in the production phase;

a plurality of second pipe sections around the base pipe, and a spacing element for spacing each of the plurality of second pipe sections from the base pipe to form an annulus between the base pipe and each of the plurality of second pipe sections;

each of the plurality of second pipe sections having a distribution element for distributing the injectant in the injection phase and for limiting influx of particulate matter in the production phase;

each of the plurality of second pipe sections around the base pipe such that at least a portion of the distribution element is over at least one of the plurality of spaced-apart slots, wherein the injectant flowing through the base pipe flows outwardly through the plurality of spaced-apart slots and is distributed outwardly to the reservoir through the distribution element during the injection phase; and, in the production phase, hydrocarbons flow inwardly through the distribution element to the plurality of spaced-apart slots and into the base pipe; and at least two first dividers between the base pipe and each of the plurality of second pipe sections compartmentalizing the annulus into first compartments for feeding the inwardly flowing hydrocarbons to at least one of the plurality of spaced-apart slots, wherein each of the first compartments feeds exactly one of the plurality of spaced-apart slots.

12. A system for distributing a viscosity reducing injectant, in an injection phase and for producing hydrocarbons in a production phase from a well in a reservoir, comprising:

a base pipe having a plurality of spaced-apart slots in a wall of the base pipe, wherein the plurality of spaced-apart slots represent an open area in the base pipe of less than 0.5%, and wherein the plurality of spaced-apart slots are sized to limit influx of particulate matter in the production phase;

a plurality of second pipe sections around the base pipe, and a spacing element for spacing each of the plurality of second pipe sections from the base pipe to form an annulus between the base pipe and each of the plurality of second pipe sections;

each of the plurality of second pipe sections having a distribution element for distributing the injectant in the injection phase and for limiting influx of particulate matter in the production phase;

each of the plurality of second pipe sections around the base pipe such that at least a portion of the distribution element is over at least one of the plurality of spaced-apart slots, wherein the injectant flowing through the base pipe flows outwardly through the plurality of spaced-apart slots and is distributed outwardly to the reservoir through the distribution element during the injection phase; and, in the production phase, hydrocarbons flow inwardly through the distribution element to the plurality of spaced-apart slots and into the base pipe, wherein the distribution element comprises:

at least one collar, each collar over at least one of the plurality of spaced-apart slots in the base pipe when each of the plurality of second pipe sections is around the base pipe; and a wire-wrap screen, slotted liner, or a steel wool screen, and wherein the system further comprises at least two second dividers between the wire-wrap screen, slotted liner, or steel wool screen, and the base pipe compartmentalizing an annulus therebetween into second compartments feeding the inwardly flowing hydrocarbons to the first compartments.

13. A method for distributing a viscosity reducing injectant, and producing hydrocarbons from a well in a reservoir, comprising the steps of:

injecting the injectant, into a base pipe having a plurality of spaced-apart slots in the wall thereof, wherein the plurality of spaced-apart slots represent an open area in the base pipe of less than 0.5%, and wherein the spaced-apart slots are sized to limit influx of particulate matter in the well, wherein a plurality of second pipe sections are around the base pipe, wherein each of the plurality of second pipe sections are spaced from the base pipe to form an annulus therebetween, wherein each of the plurality of second pipe sections have a distribution element for distributing the injectant, wherein each of the plurality of second pipe sections are around the base pipe such that at least a portion of the distribution element is over the slots, such that the injectant flows outwardly from the slots to the distribution element of each second pipe section into the reservoir such that hydrocarbons in the reservoir become mobile, and wherein at least two first dividers are between the base pipe and each of the plurality of second pipe sections compartmentalize the annulus into first compartments for feeding inwardly flowing hydrocarbons to at least one of the plurality of spaced-apart slots; and producing the hydrocarbons by discontinuing injection and allowing the hydrocarbons to flow through the distribution element into the annulus between each of the plurality of second pipe sections and the base pipe such that influx of particulate matter is limited by the distribution element.

14. The system of claim 13, wherein the injecting and producing steps are repeated cyclically.

15. The system of claim 13, wherein the well is a horizontal well.

* * * * *